United States Patent [19]

Churlaud

[11] 4,175,869

[45] Nov. 27, 1979

[54] MIXER FOR DIFFERENT PRODUCTS AND IN PARTICULAR FOR FOUNDRY SANDS

[75] Inventor: Henri A. Churlaud, Brunoy, France

[73] Assignee: Societe Anonyme des Etablissements Ph. Bonvillan & E. Ronceray, Choisy-le-Roi, France

[21] Appl. No.: 917,120

[22] Filed: Jun. 19, 1978

[30] Foreign Application Priority Data

Jun. 29, 1977 [FR] France ..... 77 20007

[51] Int. Cl.[2] ..... B01F 7/16

[52] U.S. Cl. ..... 366/42; 366/65; 366/309

[58] Field of Search ..... 366/64, 67, 65, 68, 366/66, 42, 54, 56, 57, 220, 309

[56] References Cited

U.S. PATENT DOCUMENTS 3,635,449 1/1972 Johnson ..... 366/66

FOREIGN PATENT DOCUMENTS 913567 12/1962 United Kingdom ..... 366/56

*Primary Examiner*—George F. Mautz

*Attorney, Agent, or Firm*—Weingarten, Maxham & Schurgin

[57] ABSTRACT

A mixer for different products and in particular for foundry sands.

This mixer, which comprises a frame supporting a fixed mixing tank whose axis is vertical and which is provided with an emptying trap, and at least one vertical turbine plunging into the tank, in the neighborhood of the sidewall thereof, is characterized in that the tank is provided with a rotating bottom able to be rotated by a driving member, and in that the emptying trap is formed in the sidewall of the tank, in a zone other than that concerning the turbine.

Application: preparation of foundry sands.

9 Claims, 3 Drawing Figures

MIXER FOR DIFFERENT PRODUCTS AND IN PARTICULAR FOR FOUNDRY SANDS

The present invention concerns a mixer for different products and in particular for foundry sands, of the type comprising a frame supporting a fixed mixing tank whose axis is vertical and which is provided with an emptying trap, and at least one vertical turbine plunging into the tank in the vicinity of the sidewall thereof.

The principal difficulties appearing in the preparation and the regeneration of foundry sands are to be found essentially in the mixing of their constituents, which must be both very energetic and very rapid.

To achieve such a mixing, it has been proposed to prepare foundry sands in a rotating tank equipped with a turbine. This solution however does not give entire satisfaction. In fact, the apparatus necessary for driving the tank is complex and costly. Moreover, the emptying of the prepared sand poses numerous problems. This must in fact be discharged in a fixed place so as to be able to be taken up by appropriate transport means, i.e. from the center of the bottom of the tank. Now, so that the sand may come to the emptying point, it is necessary to use scrapers and stirrers whose cost is generally very high and which must furthermore be frequently replaced because of the considerable wear to which they are subjected.

It has also been proposed to prepare foundry sands in a fixed tank whose construction was simpler and less costly. This tank, which may comprise a lateral emptying trap does not have to be fitted with the scrapers and stirrers mentioned above. However, its turbine is not sufficient to ensure the mixing and the emptying, so that it must nevertheless be associated with complementary mixing devices.

The present invention aims at remedying the disadvantages of these two types of apparatus and, to do this, it has as its object a mixer which is characterized in that the tank is provided with a rotating bottom able to be rotated by a driving member, and in that the emptying trap is formed in the sidewall of the tank, in a zone other than that concerning the turbine.

With this arrangement, the load of sand supported by the rotating bottom is regularly brought into the zone where the turbine develops its action and is thus subjected to a rapid and very efficient mixing.

Moreover, because of the centrifugal force developed by the rotation of the rotating bottom and of the turbine, the emptying is quickly and completely achieved without it being necessary to provide complementary members.

It will also be noted that because of the presence of the emptying trap in the sidewall of the tank, the mixer may be very easily connected to the handling systems of the sandworks.

Preferably, the driving member rotates the bottom in the opposite direction to the direction of rotation of the turbine.

The rotation of the bottom causes the creation of appropriate movements in the sand mass which is brought into contact with the turbine whose speed of rotation is high. Now, when the rotating bottom and the turbine are driven in opposite directions, it will be readily understood that these movements are more intense, which permits a better mixing.

Advantageously, the rotating bottom carries on its periphery vertical driving dogs adjacent the inner face of the tank.

The sand mass may thus be brought into the action zone of the turbine much more easily.

According to a preferred embodiment of the invention, the rotating bottom carries on its periphery an annular seal extending above an annular piece carried by the internal face of the sidewall of the tank, means being provided for axially moving this piece so as to maintain it in contact with the seal.

The risks of the sand flowing accidentally under the tank are thus practically completely eliminated. In fact, owing to the means for moving the annular piece, the seal remains always in contact therewith, even if the frictional forces to which it is subjected during rotation of the rotating bottom cause it to undergo considerable wear.

To prevent the seal from offering too great a purchase on the sand moving in the tank, it is advantageous for it to be housed in complementary grooves formed in the rotating bottom and the annular piece. If necessary, it may moreover be partially covered with an annular cover-plate whose upper face is in the extension of that of the rotating bottom.

According to a particular characteristic of the invention, the rotating bottom is located above a fixed sole plate extending under the joint where it is provided with a bore, said rotating bottom carrying on its lower face, in the vicinity of its periphery, at least one scraper extending slightly above the sole plate.

With this arrangement, the sand which might accidentally flow under the tank following a sealing defect is brought towards the bore in the sole plate from which it may be recovered.

Preferably, the bore in the sole plate is formed close to the emptying trap. The sand passing accidentally under the tank may thus be discharged into the handling systems of the sandworks and be recovered with the prepared load.

According to another particular arrangement, the tank contains a scraper located slightly above the rotating bottom, this scraper being fixed at the lower end of a vertical support carried by the frame and mounted in the axis of the tank.

The sand which is at the center of the tank is thus forced to come into the action zone of the turbine, which improves its mixing with the rest of the load.

An embodiment of the present invention is shown by way of example in the accompanying drawings in which.

Figure 1:
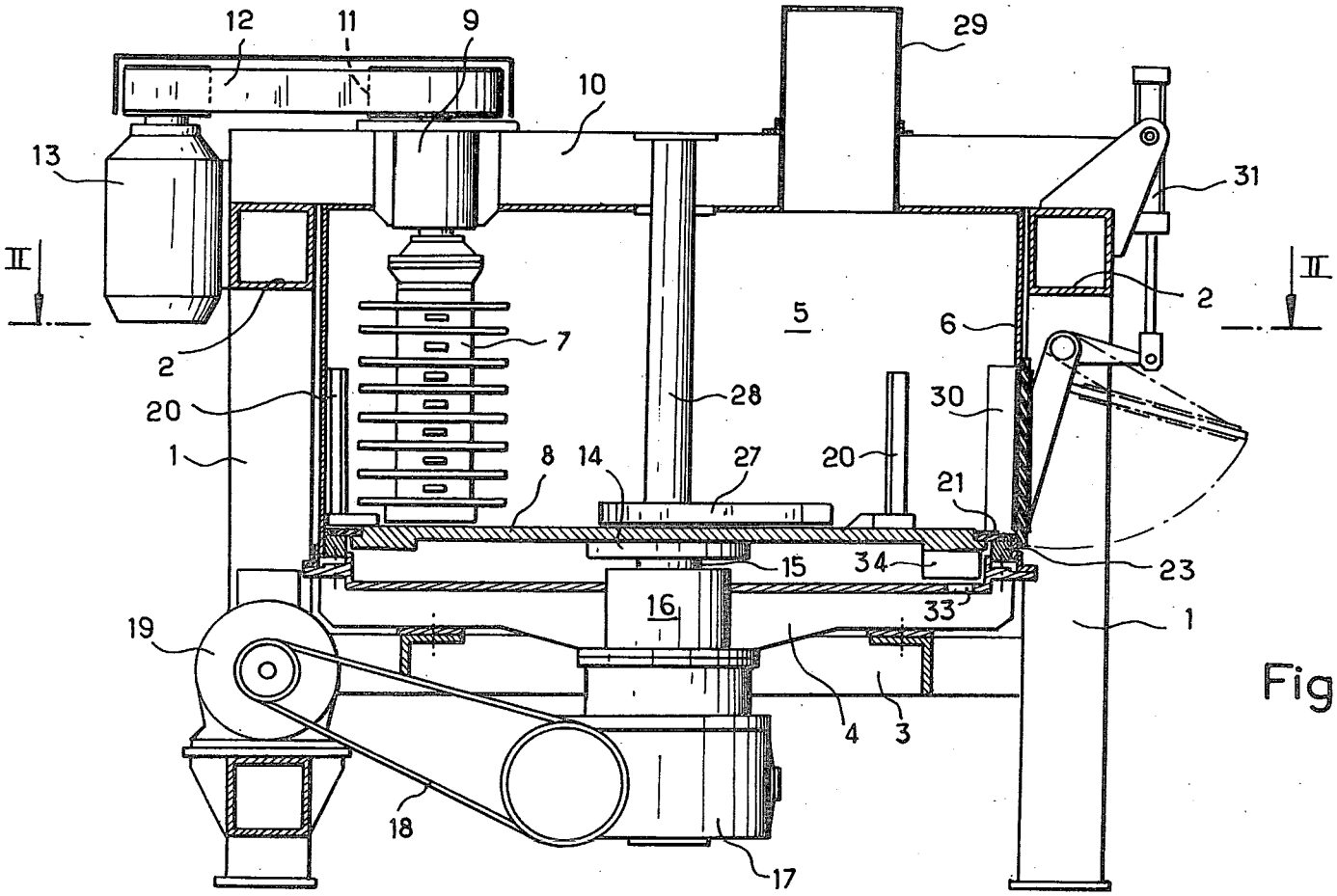
FIG. 1 is a schematic view in vertical section of the mixer according to the invention.

The mixer which may be seen in FIG. 1 is more particularly meant for the preparation of foundry sands. It comprises a frame formed of uprights 1 interconnected by cross-pieces 2 and supporting a framework 3 to which is fixed a sole plate 4. This frame carries a vertical tank 5 for receiving the load of sand to be prepared and whose sidewall 6, cylindrical and fixed, extends above the periphery of the sole plate 4.

A turbine 7, comprising blades at different levels, is located in the vicinity of sidewall 6 and extends vertically as far as the bottom 8 of the tank. At its upper end, the turbine is provided with a vertical floor-bearing 9 carried by the structure 10 closing the upper part of the tank, and with a pulley 11 over which passes a belt 12 connecting it to a drive motor 13 fixed on the frame.

In accordance with the invention, the bottom 8 of the tank is rotatable. On its lower face, it is fixed to a central plate 14 connecting it to a shaft 15 journalled in a vertical floor-bearing 16 carried by framework 3 and sole plate 4. Shaft 15 is connected, by means of a reducer 17 and belt transmission 18, to a motor 19 fixed to the frame.

It will here be noted that the rotating bottom and the turbine 7 are preferably driven in opposite directions so that the sand is subjected to a particularly intense mixing.

On its periphery, bottom 8 carries vertical dogs 20, adjacent the sidewall 6 of the tank and intended to complete the driving and the mixing of the load of sand being prepared.

Figure 3:
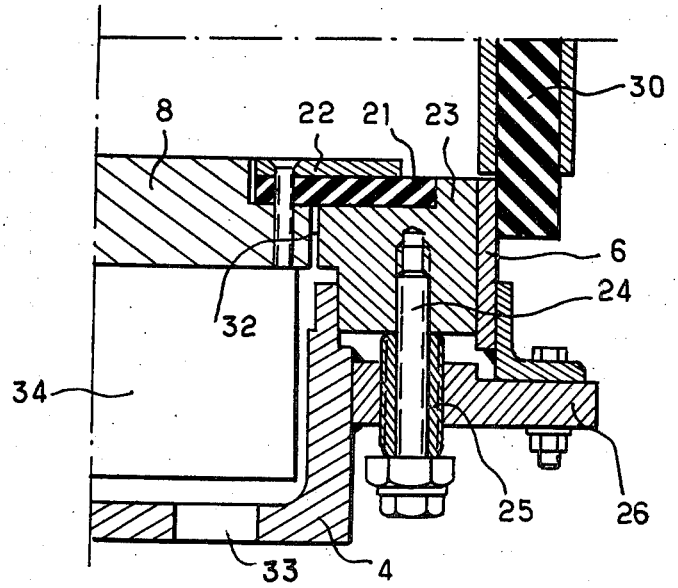
FIG. 3 is an enlarged sectional view showing the seal.

As can be seen particularly well in FIG. 3, the rotating bottom is furthermore provided, on its periphery, with an annular groove in which are fixed a seal 21 and a cover-plate 22, the upper face of this latter being in the extension of that of the rotating bottom.

Seal 21 extends above an annular piece 23 carried by the inner face of the sidewall 6 of the tank. This piece, which is provided with an annular groove in which is housed seal 21, is axially movable through threaded rods 24 rotating with sleeves 25 screwed onto a flange 26 welded to sole plate 4. It is evident that by screwing sleeves 25 the seal may be caused to remain always in contact with piece 23, even if the frictional forces generated during the rotation of the bottom subject it to considerable wear. The risks of the sand escaping under the tank are thus practically nil.

In the example shown, it will moreover be noticed that the tank contains a scraper 27 located slightly above its bottom. This scraper, which is fixed at the lower end of a vertical support 28 supported by structure 10 along the axis of the tank, serves principally to deflect the sand to be found at the central part of the bottom so that it is forced to come into the action zone of the turbine.

Filling the tank takes place from a storage hopper, not shown, situated above structure 10 which is provided with an appropriate orifice through which the sand can pass, as well as a vent chimney 29 which can be seen in FIG. 1. As for emptying, it takes place from an outlet orifice formed in its sidewall, here opposite to the turbine, this orifice being situated above a belt transporter not shown for discharging the sand towards the user station. A door 30 actuated in a manner known per se by a pneumatic control 31 ensures at the right moment the opening and the closing of the outlet orifice.

It will finally be noted that accidental leaks of sand which might occur under the tank through gap 32 provided between bottom 8 and piece 23 could be recovered, and this so as not to hinder the operation of the mixer.

In fact, as can be seen in FIG. 3, sole plate 4 is provided in the vicinity of its periphery, with a bore 33 located close to door 30 whereas rotating bottom 8 carries on its lower face also in the vicinity of its periphery, a scraper 34 extending slightly above the sole plate. It is evident that during rotation of the rotating bottom, this scraper moves the sand on the sole plate and brings it above bore 33 from which it can be directed in a manner known per se towards the belt transporter.

To prepare and/or regenerate foundry sand with the mixer of the invention, the following is how to set about it:

First of all, pneumatic control 31 is actuated to close door 30 and motors 13 and 19 are started up. The turbine and the bottom 8 then rotate respectively in the directions shown by arrows F and G.

Figure 2:
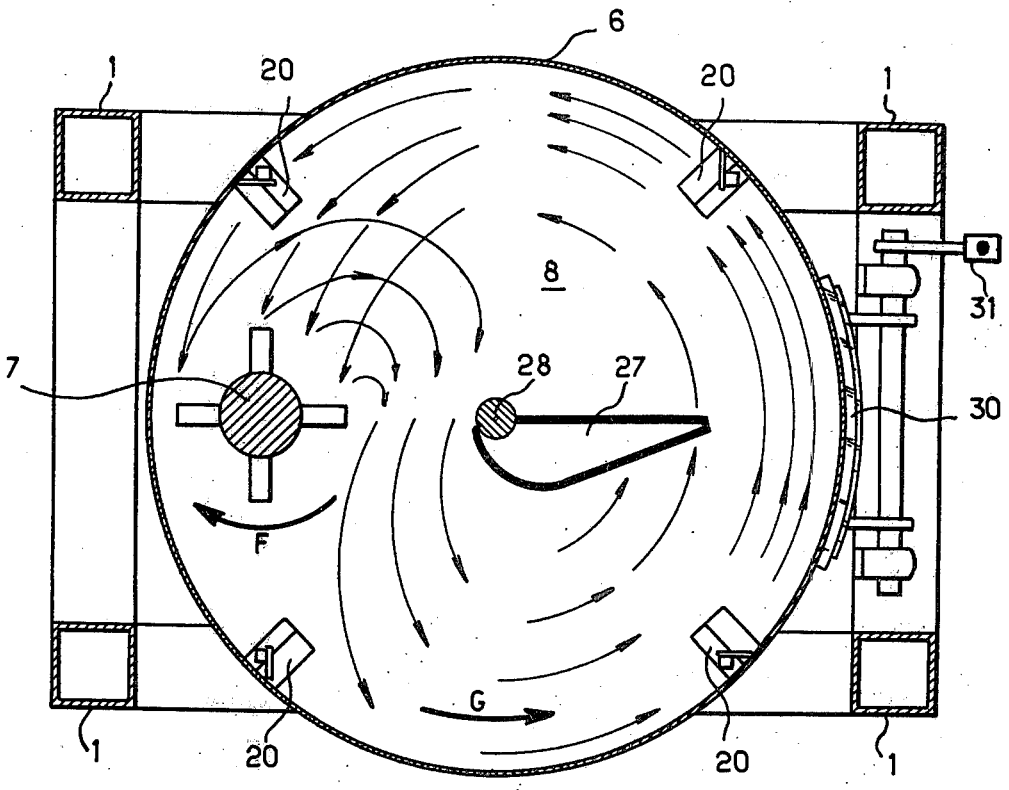
FIG. 2 is a sectional view along line II—II of FIG. 1.

There is then fed into the tank the load of sand and binding materials, the proportions of which have been gauged by volumetry or gravimetry. This load is immediately driven by the rotating bottom and, under the effect of centrifugal force, it tends to spread out along sidewall 6, there where dogs 20 exert their action and so facilitate feeding it towards the turbine. This latter, whose rotational speed is very high then momentarily deflects the sand towards the center of the tank, as shown by the arrows in FIG. 2, while subjecting it to an intense mixing. Then, when the sand is sufficiently far from the turbine, it comes back along the sidewall of the tank to reach once more the action zone of the turbine. It will here be noted that the length of the turbine is comparable to the height of the sand mass, which causes it to exert its action uniformly.

During the operation of the mixer, the sand which is in the central part of the rotating bottom is deflected towards wall 6 by dog 27 and is so forced to come into the action zone of the turbine to be mixed therein with the rest of the load.

Because of the intensity and the diversity of the movements to which it is subjected, the load is rapidly mixed, so that it may be discharged after a short stay in the tank. Its discharge is moreover rapidly achieved. In fact, when door 30 is opened, the whole of the load, because of the centrifugal force generated by the rotation of the rotating bottom, escapes practically instantaneously through the outlet orifice.

In the example shown, the mixer is constructed to operate with successive loads. It is evident that it could operate continuously provided that a few arrangements are made which do not modify the spirit of the invention.

From the above, it can thus be seen that the mixer of the invention, while having a simple and robust structure, allows a very rapid and very satisfactory preparation of foundry sands.

What is claimed is:

1. A mixer for foundry sands comprising:

a frame;

a mixing tank supported by said frame, said tank comprising:

a bottom member of said tank arranged to rotate in a substantially horizontal plane about a vertical axis; and a cylindrical side wall fixed to said frame;

a turbine extending substantially vertically into said tank at a location displaced from the axis of said bottom member;

means for rotating said bottom member;

means for rotating said turbine; and an emptying trap in said side wall of said tank, said trap being circumferentially displaced from the location of said turbine.

2. A mixer according to claim 1, characterized in that said bottom member rotating means drives the rotating bottom in the opposite direction to the direction of rotation of the turbine.

3. A mixer according to claim 1 or 2, characterized in that the rotating bottom carries on its periphery a plurality of vertical driving dogs located adjacent the internal side wall of the tank.

4. A mixer according to any one of claims 1 or 2 characterized in that the rotating bottom carries on its periphery an annular seal extending above an annular piece carried by the internal face of the sidewall of the tank, means being provided for axially moving this piece so as to maintain it in contact with the seal.

5. A mixer according to claim 4, characterized in that the seal is housed in complementary grooves formed in the rotating bottom and the annular piece.

6. A mixer according to claim 4, characterized in that the seal is partially covered by an annular cover-plate whose upper face is in the extension of that of the rotating bottom.

7. A mixer according to claim 4, characterized in that the rotating bottom is located above a fixed sole plate extending under the seal where it is provided with a bore, said rotating bottom carrying on its lower face, in the vicinity of its periphery, at least one scraper extending slightly above the sole plate.

8. A mixer according to claim 7, characterized in that the bore in the sole plate is formed close to the emptying trap.

9. A mixer according to claim 4, characterized in that the tank contains a scraper located slightly above the rotating bottom, this scraper being fixed at the lower end of a vertical support carried by the frame and mounted in the axis of the tank.

* * * * *